US008312570B1

(12) United States Patent
Chen

(10) Patent No.: US 8,312,570 B1
(45) Date of Patent: Nov. 20, 2012

(54) QUICK-INSTALLATION STRUCTURE OF A TOILET SEAT COVER ASSEMBLY

(75) Inventor: Guo-Bin Chen, Xiamen (CN)

(73) Assignee: Hoti (Xiamen) Plumbing Inc., Xiamen, Fujian (CN)

( * ) Notice: Subject to any disclaimer, the term of this patent is extended or adjusted under 35 U.S.C. 154(b) by 155 days.

(21) Appl. No.: 12/744,478

(22) PCT Filed: Jun. 25, 2009

(86) PCT No.: PCT/CN2009/072436

§ 371 (c)(1), (2), (4) Date: May 24, 2010

(87) PCT Pub. No.: WO2010/022615

PCT Pub. Date: Mar. 4, 2010

(30) Foreign Application Priority Data

Aug. 26, 2008 (CN) ..... 2008 2 0145392

(51) Int. Cl.
*A47K 13/12* (2006.01)

(52) U.S. Cl. ..... 4/236; 4/240

(58) Field of Classification Search ..... 4/236, 240; 16/324, 326

See application file for complete search history.

(56) References Cited

U.S. PATENT DOCUMENTS 4,970,731 A * 11/1990 Fait ..... 4/234
5,010,601 A * 4/1991 Kobayashi et al. ..... 4/236
7,845,027 B2 * 12/2010 Er et al. ..... 4/236
8,069,533 B2 * 12/2011 Yu et al. ..... 16/326
2007/0186344 A1 * 8/2007 Cheng ..... 5/99.1
2010/0162476 A1 * 7/2010 Cavagna ..... 4/236

FOREIGN PATENT DOCUMENTS

CN 101190111 A * 6/2008

* cited by examiner

*Primary Examiner* — Gregory Huson
*Assistant Examiner* — Janie Christiansen

(57) ABSTRACT

A quick-installation structure of a toilet seat cover assembly includes two positioning rods which are fixed on a toilet and two connection devices which are disposed on the toilet seat cover assembly and correspond to the two positioning rods, respectively. Each of the connecting devices includes a sleeve formed on a toilet seat, a rotating axle fixed to a cover, a connecting block connected to the rotating axle, a connecting sleeve fitted on the connecting block and a button connected to the connecting sleeve. The connecting block includes a main body, an engaging plate and a first restoration spring. The main body is longitudinally formed with a positioning hole. The engaging plate and the first restoration spring are laterally and pivotally connected to the main body above the positioning hole. The engaging plate is moved to swing by pressing the button. The positioning rod has an annular groove at an upper portion thereof and a cone with an inclined surface. The engaging plate of the connecting device can be swing to engage with the annular groove of the positioning rod which is inserted in the connecting device, such that the toilet seat cover assembly can be assembled on or disassembled from the toilet quickly.

10 Claims, 5 Drawing Sheets

QUICK-INSTALLATION STRUCTURE OF A TOILET SEAT COVER ASSEMBLY

BACKGROUND OF THE INVENTION

1. Field of the Invention

The present invention relates to a toilet accessory, and more particularly to a quick-installation structure of a toilet seat cover assembly.

2. Description of the Prior Art

It is an important thing to clean a toilet seat cover assembly. A connecting member is used to connect the toilet seat cover assembly and the toilet. The connecting member needs a tool for installation. The present invention is to solve the problem of installing the toilet seat cover assembly without a tool.

In addition, when in use, the toilet seat cover has to be cleaned and disinfected regularly in order to keep the environmental sanitation. Sometimes, it is necessary to replace with a new one. The user has to use a tool to disassemble the conventional toilet seat cover assembly. This is time-consuming and laborious.

SUMMARY OF THE INVENTION

The primary object of the present invention is to provide a quick-installation structure of a toilet seat cover assembly, which can be assembled quickly and conveniently.

A further object of the present invention is to provide a quick-installation structure of a toilet seat cover assembly, which can be disassembled quickly without applying a force continuously.

According to the present invention, there is provided a quick-installation structure of a toilet seat cover assembly comprising two positioning rods which are fixed on a toilet and two connection devices which are disposed on the toilet seat cover assembly and correspond to the two positioning rods, respectively. Each of the connecting devices includes a sleeve formed on a toilet seat, a rotating axle fixed to a cover, a connecting block connected to the rotating axle, a connecting sleeve fitted on the connecting block and a button connected to the connecting sleeve. The connecting block includes a main body, an engaging plate and a first restoration spring. The main body is longitudinally formed with a positioning hole. The engaging plate is laterally and pivotally connected to the main body above the positioning hole. The engaging plate has an inclined surface at a rear end thereof. The first restoration spring is laterally disposed in the connecting block. One end of the first restoration spring is against the main body and another opposing end of the first restoration spring is against the rear end of the engaging plate. The button has an inclined surface corresponding to the inclined surface of the engaging plate. The button is movably connected to the connecting sleeve. The inclined surface of the button is engaged with the inclined surface of the engaging plate to swing the engaging plate. The positioning rod has an annular groove at an upper portion thereof and a cone with an inclined surface.

Preferably, the connecting block further includes a positioning pin, a push block and a second restoration spring. The main body has a limit hole which is laterally disposed from a middle portion of the positioning hole to a rear end of the main body and a longitudinal through hole which is disposed close to the positioning hole to accommodate the positioning pin and the second restoration spring. The push block is disposed in the limit hole and confined by the positioning pin. The through hole communicates with the limit hole. The positioning rod has a reverse conical surface below the annular groove and a reduced neck below the reverse conical surface.

Preferably, the positioning pin has a pin portion at an upper end thereof and a block at a lower end thereof. The block has an inclined surface thereon.

Preferably, the push block has a curved head at a front end thereof and a block at a rear end thereof. The block has an inclined surface and a positioning slot at a middle portion thereof.

Preferably, the main body has a hole at a front portion thereof for insertion of a neck formed at a rear portion of the rotating axle and a recess on top of a rear portion thereof. The engaging plate is laterally and pivotally connected in the recess.

Preferably, the engaging plate has a front end which is connected to an inner side of the positioning hole with a shaft, a middle curved portion corresponding to the positioning hole and the inclined surface at the rear end thereof.

Preferably, the engaging plate has a protrusion behind the inclined surface of the engaging plate to position the first restoration spring.

Preferably, the engaging plate has a protruding post close to the middle curved portion.

Preferably, the connecting sleeve has a notch which is disposed at a side of the connecting sleeve and corresponds in position to the positioning hole of the connecting block. A front end of the connecting sleeve is inserted in the sleeve and a rear end of the connecting sleeve is formed with a reduced hole.

Preferably, the button has a protruding block at a front end thereof, a stop wall next to the protruding block, and a press portion next to the stop wall. The protruding block has an inclined surface corresponding to the inclined surface of the engaging plate.

The connecting block is provided with the engaging plate to engage with the positioning rod which is inserted in the connecting device, such that the toilet seat cover assembly can be installed on the toilet quickly.

Besides, the connecting block is provided with the positioning pin, the push block and the second restoration spring. To disassemble the toilet seat cover assembly, the button is pressed to swing the engaging plate, and the positioning pin provides a delay function to limit the engaging plate for the positioning rod to disengage from the connecting device, such that pressing the button and moving the toilet seat cover assembly don't have to operated simultaneously. Only one person can disassemble the toilet seat cover assembly with ease.

DETAILED DESCRIPTION OF THE PREFERRED EMBODIMENTS

Figure 1:
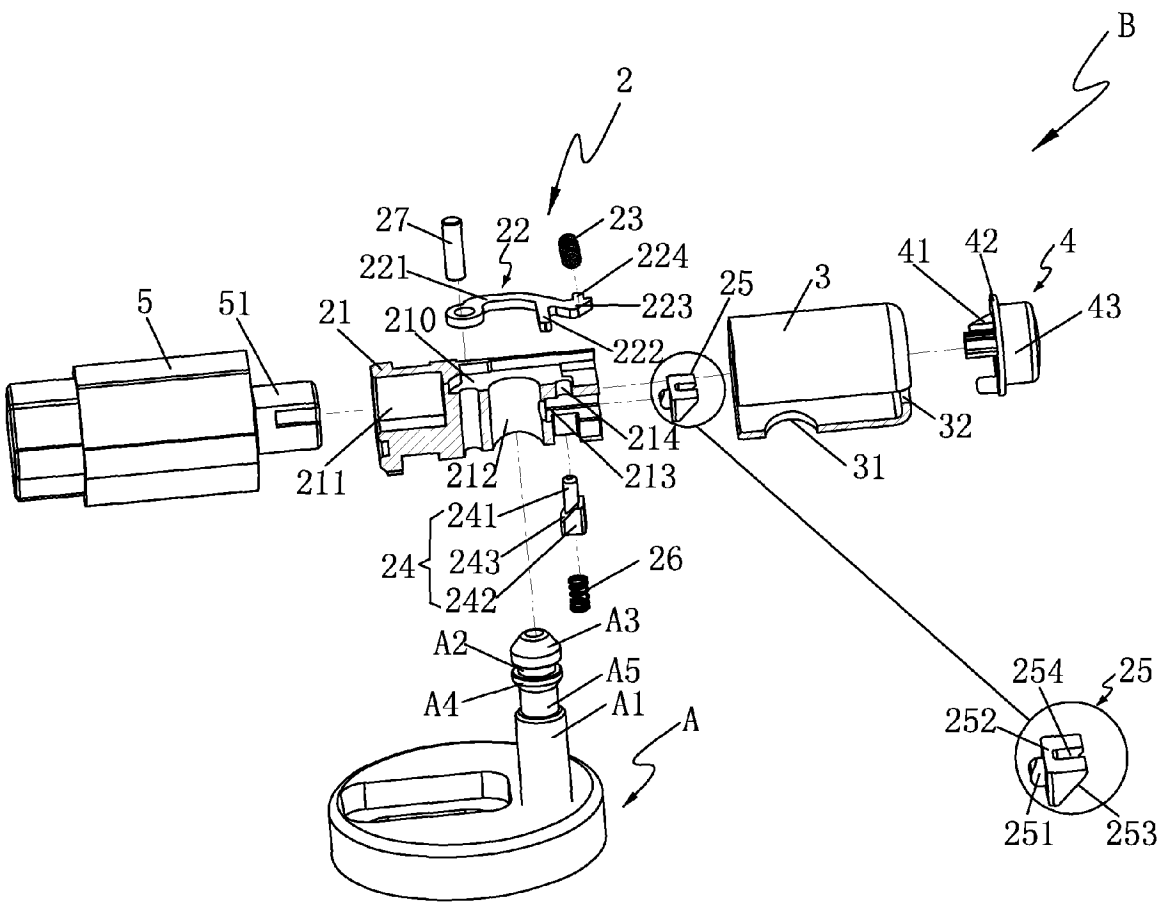
FIG. 1 is an exploded view according to a preferred embodiment of the present invention.

Embodiments of the present invention will now be described, by way of example only, with reference to the accompanying drawings.

As shown in FIGS. 1 to 9, a quick-installation structure of a toilet seat cover assembly according to a preferred embodiment of the present invention comprises two bases A which are fixed on a toilet and two connection devices B which are disposed on the toilet seat cover assembly and correspond to the two bases A, respectively. The toilet seat cover assembly includes a cover C and a toilet seat D.

Each base A has a positioning rod A1 thereon. The positioning rod A1 has an annular groove A2 at an upper portion thereof, a cone A3 which has an inclined surface and is located on top of the annular groove A2, a reverse conical surface A4 below the annular groove A2, and a reduced neck A5 below the reverse conical surface A4.

Each connecting device B includes a sleeve 1 formed on the toilet seat D, a rotating axle 5 fixed to the cover C, a connecting block 2 connected to the rotating axle 5, a connecting sleeve 3 fitted on the connecting block 2, and a button 4.

The rotating axle 5 has a front portion fixed to the cover C, a rear portion inserted in the sleeve 1, and a neck 51 at a rear end thereof.

The sleeve 1 is a cylinder.

The connecting block 2 includes a main body 21, an engaging plate 22 and a first restoration spring 23. The connecting block 2 further includes a positioning pin 24, a push block 25 and a second restoration spring 26 if a quick-release function is required.

The main body 21 has a hole 211 at a front portion thereof for insertion of the neck 51 of the rotating axle 5, a recess 210 on top of a rear portion thereof, a positioning hole 212 which is longitudinally disposed near the middle portion, a limit hole 213 which is laterally disposed from a middle portion of the positioning hole 212 to a rear end of the main body 21, and a longitudinal through hole 214 which corresponds in position to the positioning pin 24 and communicates with the limit hole 213.

The engaging plate 22 has a front end which is connected to an inner side of the positioning hole 212 with a shaft 27, a middle curved portion 221 corresponding to the positioning hole 212, a protruding post 222 close to the middle curved portion 221, an inclined surface 223 at a rear end thereof, and a protrusion 224 behind the inclined surface 223 to position the first restoration spring 23.

The positioning pin 24 has a pin portion 241 at an upper end thereof and a block 242 at a lower end thereof. The block 242 has an inclined surface 243 thereon.

The push block 25 has a curved head 251 at a front end thereof and a block 252 at a rear end thereof. The block 252 has an inclined surface 253 and a positioning slot 254 at a middle portion thereof.

The connecting sleeve 3 has a notch 31 which is disposed at a side of the connecting sleeve 3 and corresponds in position to the positioning hole 212 of the connecting block 2. A front end of the connecting sleeve 3 is inserted in the sleeve 1, and a rear end of the connecting sleeve 3 is formed with a reduced hole 32.

The button 4 has a protruding block 41 at a front end thereof, a stop wall 42 next to the protruding block 41, and a press portion 43 next to the stop wall 42. The protruding block 41 has an inclined surface corresponding to the inclined surface 223 of the engaging plate 22.

Figure 2:
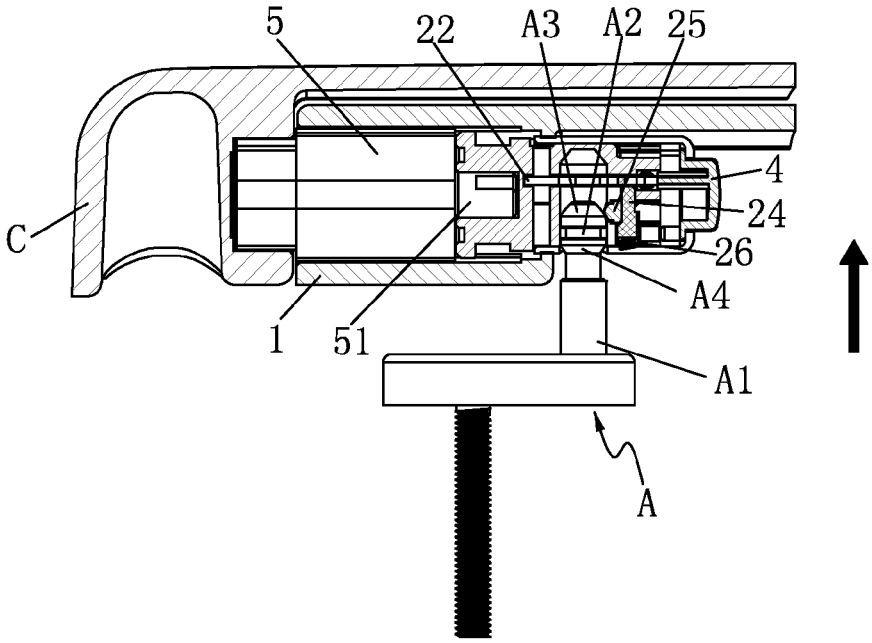
FIG. 2 is a side cross-sectional view according to the preferred embodiment of the present invention when being assembled.
Figure 3:
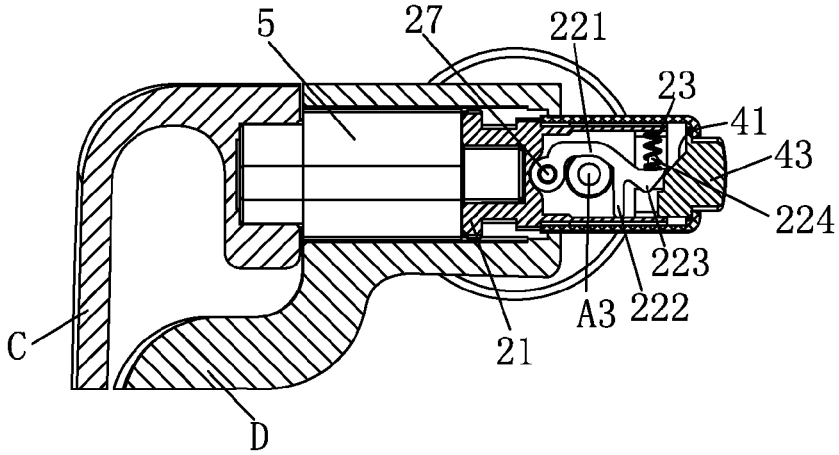
FIG. 3 is a top cross-sectional view according to the preferred embodiment of the present invention when being assembled.

FIG. 2 and FIG. 3 are to show the assembly of the present invention. The engaging plate 22 is pivotally connected to the recess 210 of the main body 21. The first restoration spring 23 is located between the engaging plate 22 and a rear side wall of the recess 210. One end of the first restoration spring 23 is against the rear side wall of the recess 210, while another opposing end of the first restoration spring 23 is fitted on the protrusion 224. The first restoration spring 23 won't disengage from the engaging plate 22 subject to the protruding post 222. The push block 25 is inserted in the limit hole 213, and the positioning pin 24 is inserted in the through hole 214 from the bottom of the main body 21. The inclined surface 243 of the block 242 of the positioning pin 24 is engaged with the inclined surface 253 of the push block 25. The second restoration spring 26 is located under the positioning pin 24 to complete the assembly of the connecting block 2. The front end of the button 4 is inserted in the connecting sleeve 3, and the stop wall 42 is against an inner wall of the reduced hole 32 of the connecting sleeve 3. The press portion 43 is exposed out of the connecting sleeve 3. The connecting sleeve 3 with the button 4 is fitted on the connecting block 2. A lower end of the second restoration spring 26 is against an inner wall of the connecting sleeve 3, and an upper end of the second restoration spring 26 is against the positioning pin 24. Finally, the connecting block 2 with the connecting sleeve 3 is connected to the rotating axle 5, and the front end of the connecting sleeve 3 is inserted in the sleeve 1.

When the connecting device B is in a normal status, the engaging plate 22 is subject to the first restoration spring 23, the middle curved portion 221 is located above the positioning hole 212, the positioning pin 24 is blocked by the engaging plate 22 and located under the engaging plate 22, and the second restoration spring 26 is compressed. The inclined surface 243 of the positioning pin 24 is against the inclined surface 253 of the push block 23, so that the head 251 of the push block 25 is retracted in the limit hole 213.

Figure 4:
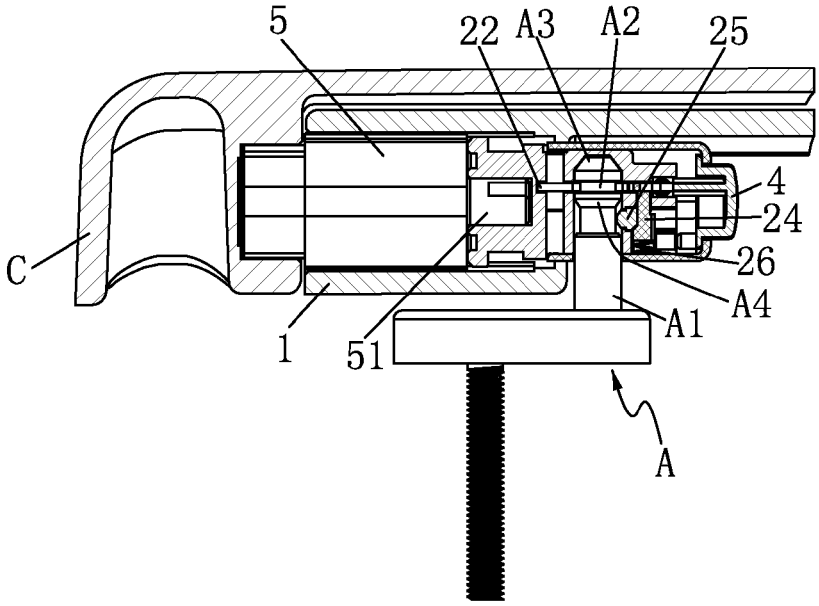
FIG. 4 is a side cross-sectional view according to the preferred embodiment of the present invention after being assembled.
Figure 5:
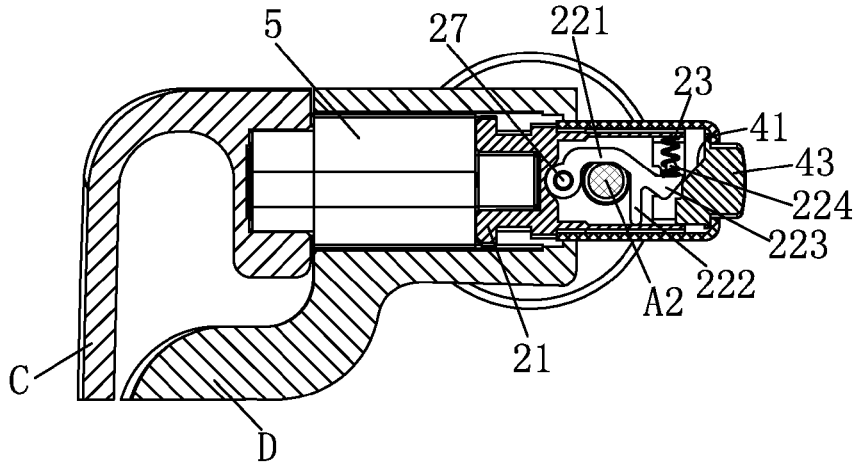
FIG. 5 is a top cross-sectional view according to the preferred embodiment of the present invention after being assembled.
Figure 6:
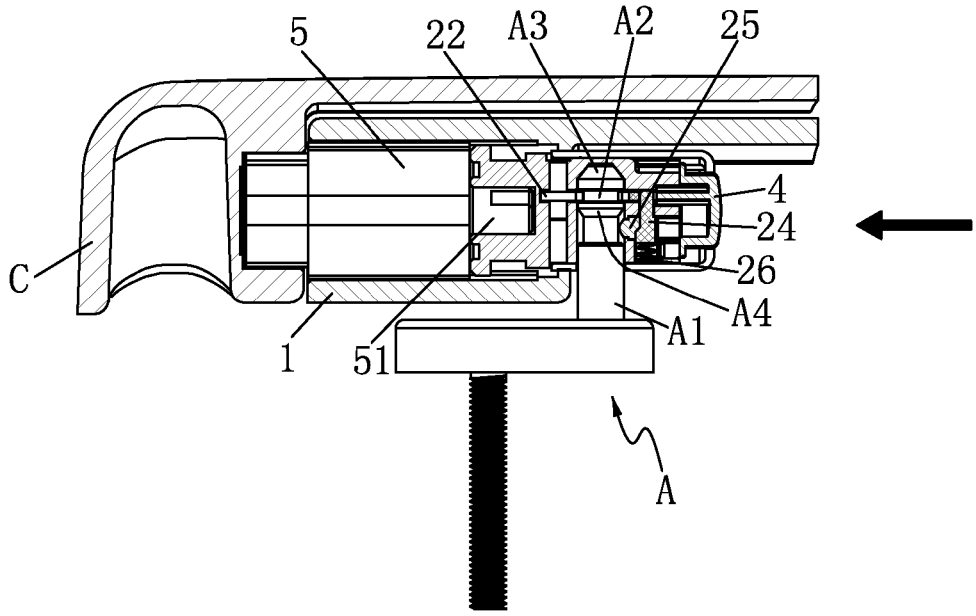
FIG. 6 is a side cross-sectional view according to the preferred embodiment of the present invention when being disassembled.
Figure 7:
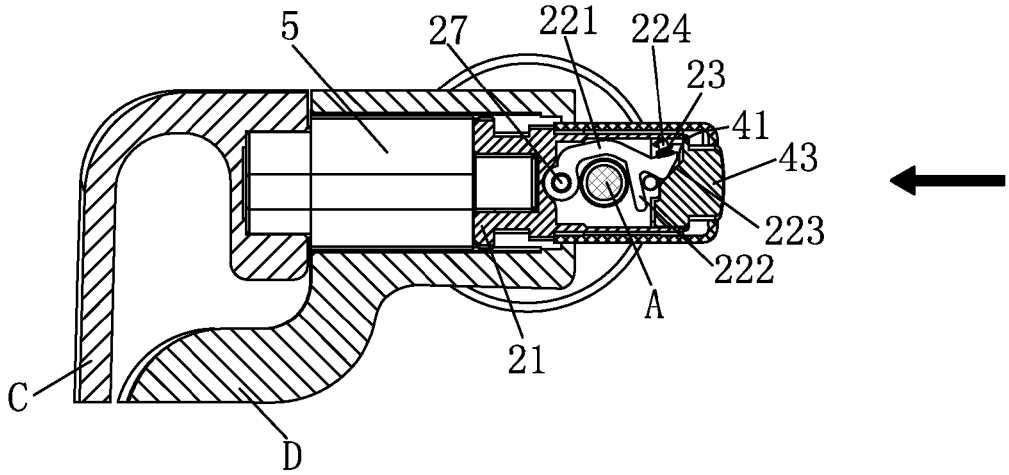
FIG. 7 is a top cross-sectional view according to the preferred embodiment of the present invention when being disassembled.
Figure 8:
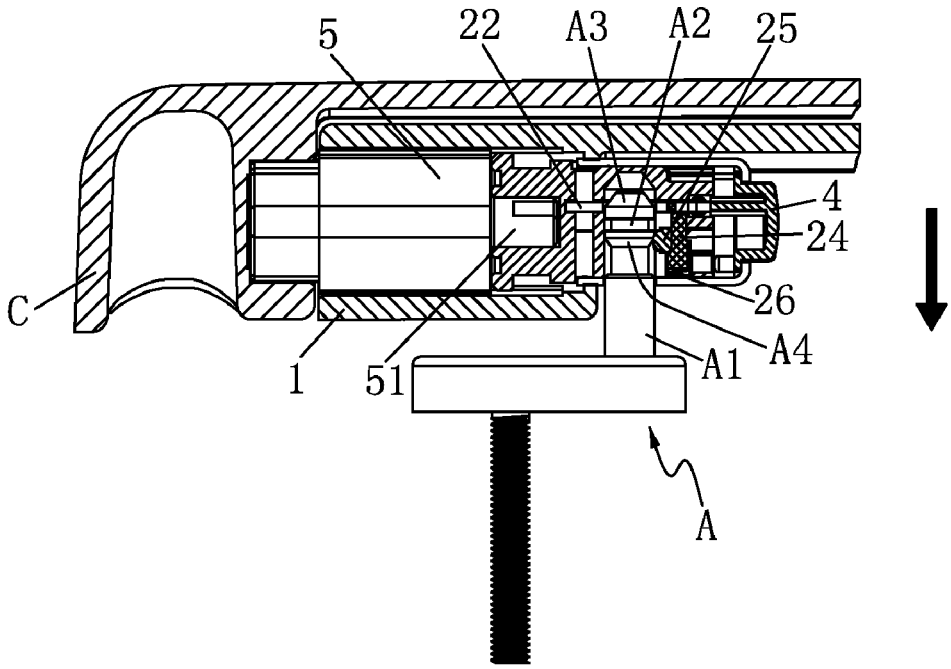
FIG. 8 is a side cross-sectional view according to the preferred embodiment of the present invention after being disassembled.
Figure 9:
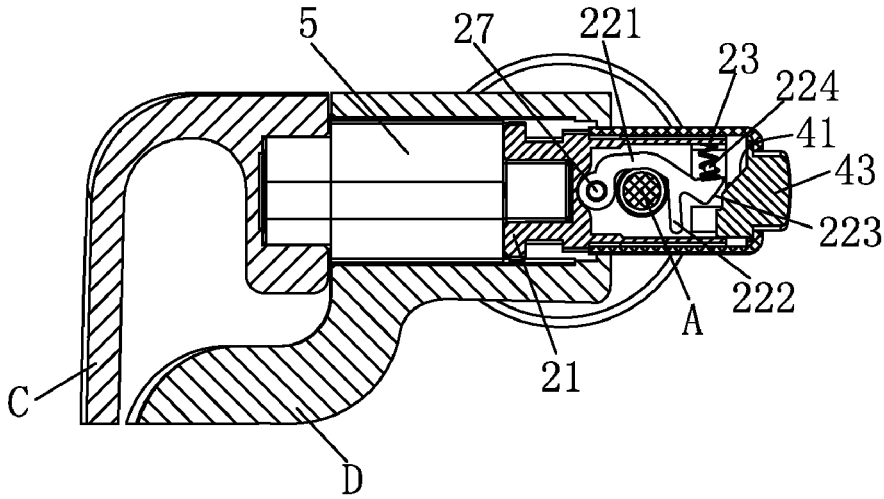
FIG. 9 is a top cross-sectional view according to the preferred embodiment of the present invention after being disassembled.

When installing the toilet seat cover, the two connecting devices B are aligned with the positioning rods A1 of the two bases A and then pressed downward. The positioning rod A1 is inserted through the notch 31 of the connecting sleeve 3 and into the positioning hole 212 of the connecting block 2. The inclined surface on the cone A3 of the positioning rod A1 pushes the engaging plate 22 to move toward the rear side wall of the recess 210 of the main body 21. The engaging plate 22 uses the shaft 24 as an axle center to turn counterclockwise. The movement of the engaging plate 22 won't cause the positioning pin 24 to disengage from the engaging plate 22. After the upper portion of the positioning rod A1 is inserted through the engaging plate 22, the engaging plate 22 urged by the first restoration spring 23 is turned clockwise to its original position. The middle curved portion 221 of the engaging plate 22 is engaged with the engaging groove A2 of the positioning rod A1, such that the toilet seat cover assembly is connected to the toilet, as shown in FIG. 4 and FIG. 5.

FIG. 6 to FIG. 9 are to show the disassembly of the present invention. When the button 4 is pressed, the inclined surface of the protruding block 41 of the button 4 will push the inclined surface 223 of the engaging plate 22 to move rearward. The engaging plate 22 releases the positioning pin 24. The positioning pin 24 urged by the second restoration spring 26 is moved upward and engaged with the inner end of the engaging plate 22 so as to prevent the engaging plate 22 from moving back. The inclined surface 253 of the push block 25 is pushed by the inclined surface 243 of the positioning pin 24, so that the head 251 is protruded in the positioning hole 212. The engaging plate 22 is disengaged from the positioning rod A1. When the toilet seat cover assembly is lifted up, the reverse inclined surface A4 below the annular groove A2 will push the head 251 to retract toward the limit hole 213 and the positioning pin 24 will be pushed by the push block 25 to move downward. The engaging plate 22 is restored to its original position by the first restoration spring 23, referring to FIG. 2 and FIG. 3. In this way, the toilet seat cover can be disassembled from the toilet smoothly and easily without pressing the button continuously. At this moment, the second restoration spring 26 is in a compressed status for next operation.

The feature of the present invention is that the connecting block 2 is provided with the engaging plate 22 to engage with the positioning rod A1 which is inserted in the connecting device B, such that the toilet seat cover assembly can be installed on the toilet quickly. Besides, the connecting block 2 is provided with the positioning pin 24, the push block 25 and the second restoration spring 26. To disassemble the toilet seat cover assembly, the button 4 is pressed to swing the engaging plate 22, and the positioning pin 24 provides a delay function to limit the engaging plate 22 for the positioning rod A1 to disengage from the connecting device B, such that pressing the button 4 and moving the toilet seat cover assembly don't have to operated simultaneously. Only one person can disassemble the toilet seat cover assembly with ease.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A quick-installation structure of a toilet seat cover assembly comprising two positioning rods which are fixed on a toilet and two connection devices which are disposed on the toilet seat cover assembly and correspond to the two positioning rods, respectively, and characterized by: each of the connecting devices including a sleeve formed on a toilet seat, a rotating axle fixed to a cover, a connecting block connected to the rotating axle, a connecting sleeve fitted on the connecting block and a button connected to the connecting sleeve; the connecting block including a main body, an engaging plate and a first restoration spring, the main body being longitudinally formed with a positioning hole, the engaging plate being laterally and pivotally connected to the main body above the positioning hole, the engaging plate having an inclined surface at a rear end thereof, the first restoration spring being laterally disposed in the connecting block, one end of the first restoration spring being against the main body and another opposing end of the first restoration spring being against the rear end of the engaging plate, the button having an inclined surface corresponding to the inclined surface of the engaging plate, the button being movably connected to the connecting sleeve, the inclined surface of the button being engaged with the inclined surface of the engaging plate to swing the engaging plate, the positioning rod having an annular groove at an upper portion thereof and a cone with an inclined surface.

2. The quick-installation structure of a toilet seat cover assembly as claimed in claim 1, wherein the connecting block further includes a positioning pin, a push block and a second restoration spring, the main body having a limit hole which is laterally disposed from a middle portion of the positioning hole to a rear end of the main body and a longitudinal through hole which is disposed close to the positioning hole to accommodate the positioning pin and the second restoration spring, the push block being disposed in the limit hole and confined by the positioning pin, the through hole communicating with the limit hole, the positioning rod having a reverse conical surface below the annular groove and a reduced neck below the reverse conical surface.

3. The quick-installation structure of a toilet seat cover assembly as claimed in claim 2, wherein the positioning pin has a pin portion at an upper end thereof and a block at a lower end thereof, the block having an inclined surface thereon.

4. The quick-installation structure of a toilet seat cover assembly as claimed in claim 2, wherein the push block has a curved head at a front end thereof and a block at a rear end thereof, the block having an inclined surface and a positioning slot at a middle portion thereof.

5. The quick-installation structure of a toilet seat cover assembly as claimed in claim 1, wherein the main body has a hole at a front portion thereof for insertion of a neck formed at a rear portion of the rotating axle and a recess on top of a rear portion thereof, the engaging plate being laterally and pivotally connected in the recess.

6. The quick-installation structure of a toilet seat cover assembly as claimed in claim 1, wherein the engaging plate has a front end which is connected to an inner side of the positioning hole with a shaft, a middle curved portion corresponding to the positioning hole and the inclined surface at the rear end thereof.

7. The quick-installation structure of a toilet seat cover assembly as claimed in claim 1, wherein the engaging plate has a protrusion behind the inclined surface of the engaging plate to position the first restoration spring.

8. The quick-installation structure of a toilet seat cover assembly as claimed in claim 1, wherein the engaging plate has a protruding post close to the middle curved portion.

9. The quick-installation structure of a toilet seat cover assembly as claimed in claim 1, wherein the connecting sleeve has a notch which is disposed at a side of the connecting sleeve and corresponds in position to the positioning hole of the connecting block, a front end of the connecting sleeve being inserted in the sleeve and a rear end of the connecting sleeve being formed with a reduced hole.

10. The quick-installation structure of a toilet seat cover assembly as claimed in claim 1, wherein the button has a protruding block at a front end thereof, a stop wall next to the protruding block, and a press portion next to the stop wall, the protruding block having an inclined surface corresponding to the inclined surface of the engaging plate.

* * * * *